US007766348B2

(12) United States Patent
McFarland et al.

(10) Patent No.: US 7,766,348 B2
(45) Date of Patent: Aug. 3, 2010

(54) COMBINATION MOBILE DISPLAY AND SHIPPING DEVICE

(75) Inventors: Scott McFarland, Racine, WI (US); Andy Kinzelman, Racine, WI (US); Bill Glassen, Racine, WI (US); Patrick Graf, Highland Park, IL (US)

(73) Assignee: Great Northern Corporation, Appleton, WI (US)

( * ) Notice: Subject to any disclaimer, the term of this patent is extended or adjusted under 35 U.S.C. 154(b) by 504 days.

(21) Appl. No.: 11/763,541

(22) Filed: Jun. 15, 2007

(65) Prior Publication Data

US 2008/0309209 A1 Dec. 18, 2008

(51) Int. Cl.
*B62D 39/00* (2006.01)
*B65D 19/44* (2006.01)

(52) U.S. Cl. ..... 280/33.995; 280/79.3; 108/55.3; 108/52.1

(58) Field of Classification Search ..... 280/33.995, 280/43.11, 47.34, 79.11, 79.3, 79.4, 79.5; 211/134; 108/53.1, 55.1, 55.3, 52.1
See application file for complete search history.

(56) References Cited

U.S. PATENT DOCUMENTS

| | | | | | |
|---|---|---|---|---|---|
| 4,804,087 | A * | 2/1989 | Smith | 206/335 |
| 5,787,817 | A * | 8/1998 | Heil | 108/57.21 |
| 6,006,676 | A * | 12/1999 | Creek et al. | 108/55.3 |
| 6,035,790 | A * | 3/2000 | Polando | 108/55.1 |
| 6,105,511 | A * | 8/2000 | Bridges | 108/55.3 |
| 6,126,131 | A * | 10/2000 | Tietz | 248/346.01 |
| 6,360,676 | B1 * | 3/2002 | Schepers | 108/52.1 |
| 6,460,950 | B2 | 10/2002 | Spitzer et al. | |
| 6,524,040 | B1 * | 2/2003 | Heil | 410/67 |
| 6,539,881 | B2 * | 4/2003 | Underbrink et al. | 108/55.3 |
| 6,640,729 | B1 * | 11/2003 | Wei-Bin | 108/51.3 |
| D486,324 | S | 2/2004 | Mason | |
| 7,131,543 | B2 | 11/2006 | Mason | |
| D537,274 | S | 2/2007 | Pirro et al. | |
| 7,520,390 | B2 * | 4/2009 | Sonon | 206/774 |
| 2004/0017055 | A1 * | 1/2004 | Panasewicz et al. | 280/33.998 |
| 2004/0195195 | A1 * | 10/2004 | Mason | 211/134 |
| 2005/0110373 | A1 | 5/2005 | Assmann | |
| 2007/0193479 | A1 * | 8/2007 | Slaats | 108/53.1 |

* cited by examiner

*Primary Examiner*—Glenn Dayoan
*Assistant Examiner*—John R Olszewski
(74) *Attorney, Agent, or Firm*—Andrus, Sceales, Starke & Sawall, LLP

(57) ABSTRACT

A combination mobile display and shipping device that allows product to be loaded onto the mobile display such that the display can be shipped in a loaded condition. The mobile display includes a product display and a support platform having a plurality of wheels mounted to the bottom surface of the support platform. When the mobile display is received at a retail location, the mobile display can be moved to a desired position through the rolling movement of the plurality of wheels. During shipment, the support platform is securely attached to a shipping pallet designed such that the plurality of wheels are suspended above the ground surface to prevent the rolling movement of the mobile display during shipment. After shipment, the support platform and shipping pallet are separated such that the mobile display can be rolled into a desired location with the product loaded on the display rack.

7 Claims, 5 Drawing Sheets

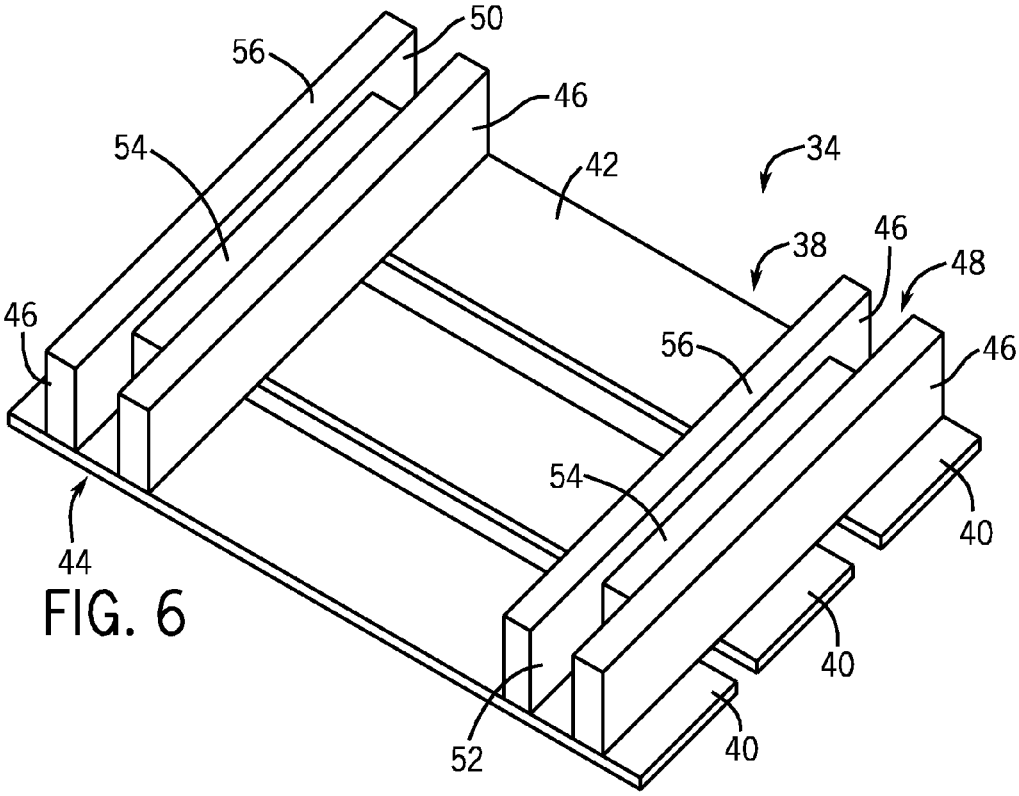
FIG. 6
FIG. 7
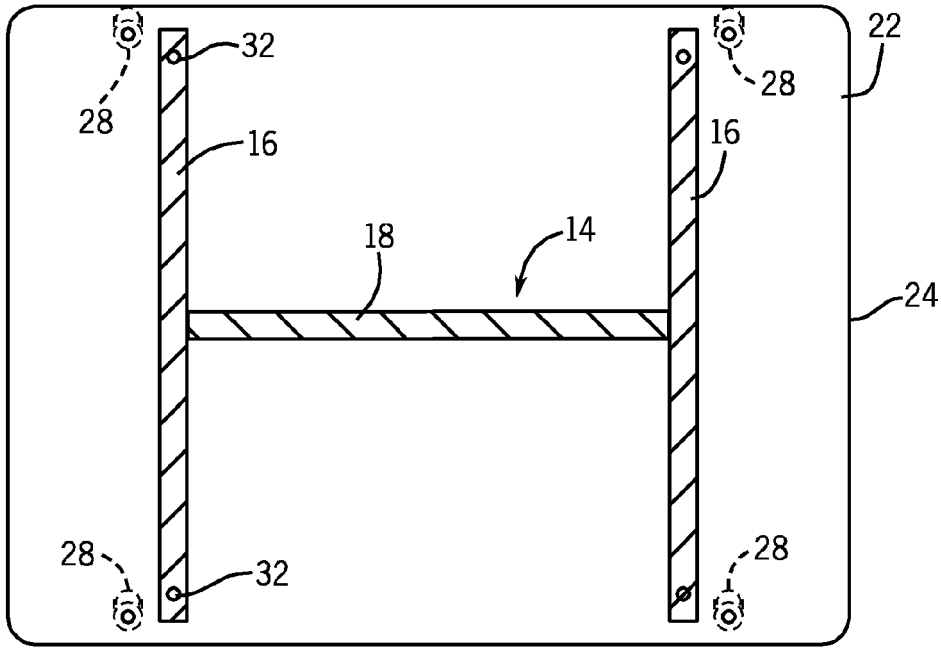

COMBINATION MOBILE DISPLAY AND SHIPPING DEVICE

BACKGROUND OF THE INVENTION

The present invention generally relates to a mobile display and a device for shipping the display. More specifically, the present invention relates to a combination mobile display and shipping device in which a support platform of the mobile display is securely connected to a shipping pallet during shipment such that the shipping pallet prevents movement of the mobile display during the shipping process.

Manufacturers of consumer products oftentimes develop unique product displays, which may include display racks for displaying products in retail outlets. The product displays include the product being sold and are visually appealing to attract consumer attention. Many times, the product displays are shipped to the retail outlet in a broken down, unloaded condition, which requires the display to be assembled at the retail outlet and loaded with product at the retail outlet. These types of displays require a significant amount of personnel time by workers at the retail outlet to both assemble the display and load the display with product. For large retail outlets, the time required to load and/or build the display is either unacceptable or, at a minimum, undesirable.

Many manufacturers have taken to assembling and loading the product displays with product prior to the loaded display being shipped to the retail outlet. When using these types of display systems, the retail outlet receives the display loaded with product such that the retail outlet only needs to remove the shipping material and position the loaded display at a desired location within the retail outlet.

Since the display is loaded with product, the weight of the loaded display makes manual movement of the display to a desired location at the retail outlet difficult. When dealing with loaded product displays, personnel at the retail outlet will typically utilize a pallet jack to move the loaded display into a desired location before lowering the display onto the floor of the retail outlet.

Although loading a display with product prior to shipment reduces the amount of time required to set up the display and load the product, the use of pallet jacks to position the loaded display requires trained personnel and a relatively large mechanical device to move the loaded product display to the desired position within the retail outlet.

Therefore, a need currently exists for a mobile display and shipping device that allows a display to be shipped loaded with product and easily moved about a retail outlet once the loaded display has been received at the retail outlet. Further, a need exists for a shipping device that allows the loaded, mobile display to be safely shipped while allowing the mobile display to be accurately positioned within the retail outlet without requiring a significant amount of personnel time and effort.

SUMMARY OF THE INVENTION

The present invention relates to a combination mobile display and shipping device that allows a product display loaded with product to be shipped to a retail outlet and moved around the retail outlet using wheels contained on the mobile display. The combination mobile display and shipping device allows product to be loaded onto the display prior to shipment such that upon being received at the retail outlet, the mobile display can be used without requiring additional loading by personnel at the retail outlet.

The mobile display generally includes a support platform that has a top surface and a bottom surface. The bottom surface of the support platform includes a plurality of wheels that allow the support platform to roll along a ground surface. A product display, such as a display rack having a series of horizontal display shelves, is mounted to a top surface of the support platform such that the combination of the display rack and support platform can be moved around a retail location by using the wheels mounted to the support platform.

Preferably, the display can be loaded with product prior to shipment to a retail outlet. During shipment, the support platform is mounted onto a shipping pallet that includes a series of spaced uprights that define at least a pair of wheel channels. When the support platform is mounted to the shipping pallet, each of the plurality of wheels mounted to the bottom surface of the support platform is received within the wheel channel and is suspended above the ground surface. Thus, when the support platform is received on the shipping pallet, the shipping pallet prevents the wheels from rolling along the ground surface.

Preferably, the support platform is securely attached to the shipping pallet by one or more shipping bands. The shipping bands prevent the separation of the support platform from the shipping pallet. Once the combined mobile display and shipping device are received at the desired location, the shipping bands are cut to allow separation between the support platform and the shipping pallet.

Once the shipping bands have been cut, the support platform is elevated above the shipping pallet, preferably by a pallet jack, and the shipping pallet is removed. The support platform is then lowered onto the ground surface such that the wheels of the support platform allow the entire mobile display to be rolled into the desired location for display.

BRIEF DESCRIPTION OF THE DRAWINGS

The drawings illustrate the best mode presently contemplated of carrying out the invention. In the drawings:

FIG. 6 is a perspective view of the shipping pallet; and

FIG. 7 is a section view illustrating the position of the product display on the support platform.

DETAILED DESCRIPTION OF THE INVENTION

Figure 1:
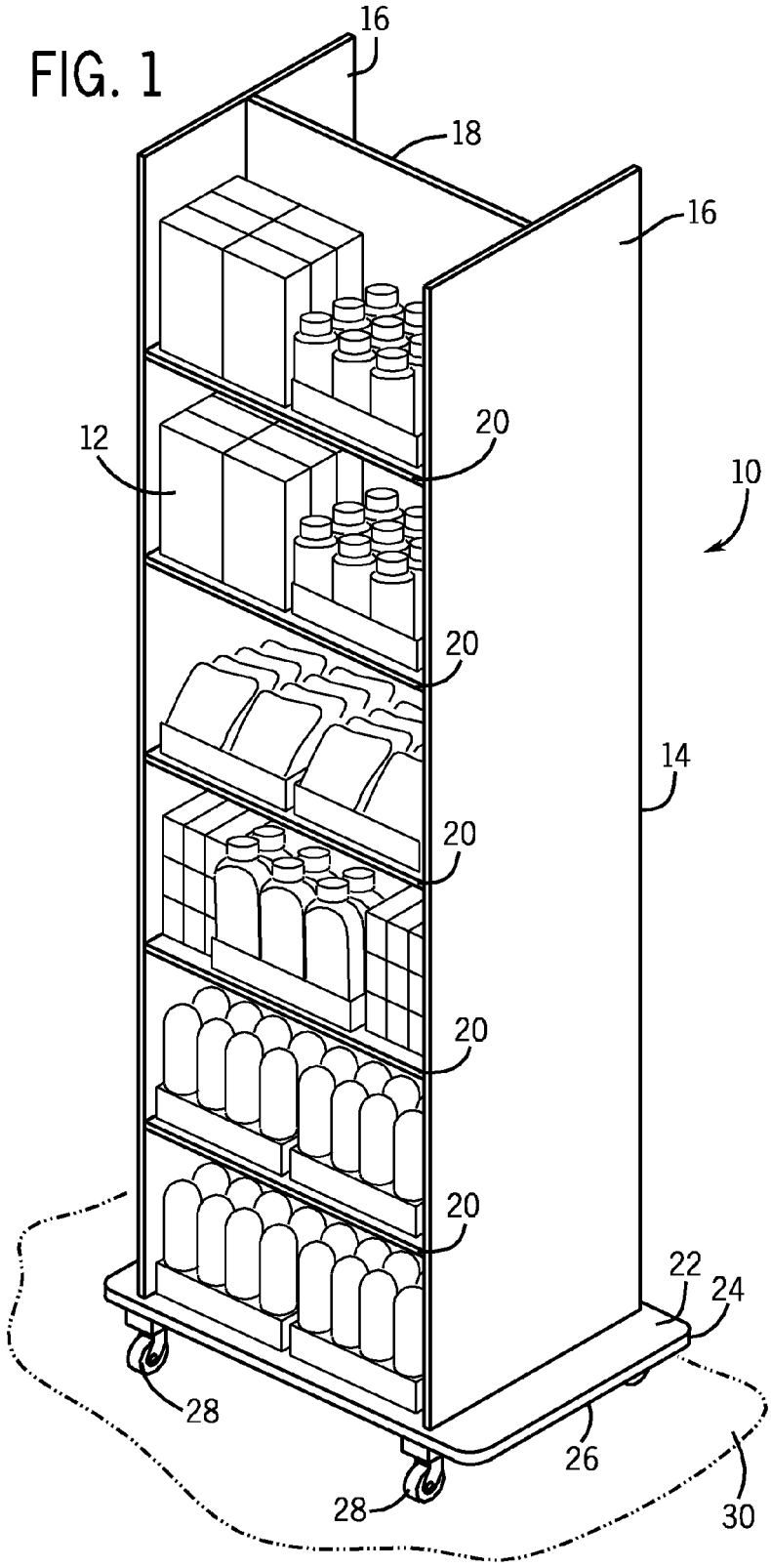
FIG. 1 is a perspective view illustrating the mobile display loaded with product.

FIG. 1 illustrates a mobile display 10 used to display and market a series of products 12, such as at a retail outlet. In the embodiment illustrated in FIG. 1, the mobile display 10 includes a product display, such as a display rack 14 having a pair of spaced sidewalls 16 and a center wall 18 extending between the pair of spaced sidewalls 16. In the embodiment shown, the display rack 14 includes a series of horizontal shelves 20 that each provide a support surface for individual rows of products 12. In the embodiment illustrated, the sidewalls 16, center wall 18 and shelves 20 can be formed from many different types of durable materials that have adequate strength to support the weight of the individual products 12.

As an example, the sidewalls 16, center wall 18 and shelves 20 can be formed from paperboard, corrugated cardboard, wood or any other type of suitable material. Additionally, although the mobile display 10 in FIG. 1 includes five individual shelves 20, the mobile display 10 could have a greater or fewer number of shelves 20 while operating within the scope of the present disclosure. Although the product display shown in the drawing Figures is a display rack 14 having multiple shelves, it should be understood that the product display could take many other forms depending on the manufacturer and the product being displayed. The display rack 14 described throughout the following description could be replaced by other types of product displays while operating within the scope of the contemplated invention.

As shown in FIG. 1, the display rack 14 is supported on a top, planar surface 22 of a support platform 24. The support platform 24 includes a planar bottom surface 26 that includes a plurality of wheels 28. In the embodiment shown in FIG. 1, the wheels 28 are caster wheels, although various other types of wheel arrangements are contemplated as being within the scope of the present disclosure. In the embodiment shown in FIG. 1, the support platform 24 is formed from a durable high strength material, such as wood, that is capable of supporting the weight of the display rack 14 when the display rack 14 is loaded with multiple rows of products 12.

When the display rack 14 is fully loaded with product 12, the entire display rack 14 can be easily moved along the ground surface 30 by the rolling movement of the wheels 28. The ground surface 30 could be the floor of a retail outlet, the floor of a moving truck or any other type of surface over which rolling movement of the entire mobile display 10 is possible.

When utilizing the mobile display 10 shown in FIG. 1, the product manufacturer can load the product 12 onto the individual display shelves 20 prior to shipment of the entire mobile display 10 to the retail outlet. As shown in FIG. 7, the display rack 14 is securely attached to the support platform 24 by a series of connectors received within the individual openings 32 formed in each of the spaced sidewalls 16. Thus, the support platform 24 and the display rack 14 can be securely attached to each other to form a stable, unitary structure that can withstand the forces incurred during shipment of the mobile display.

Although it is contemplated that the entire display rack 14 will be loaded with product 12 before shipment, it should be understood that the mobile display 10, including the display rack 14 and the support platform 24, could be shipped without the product 12 and the product 12 loaded onto the display rack 14 once the display rack 14 is received at the retail outlet.

Figure 2:
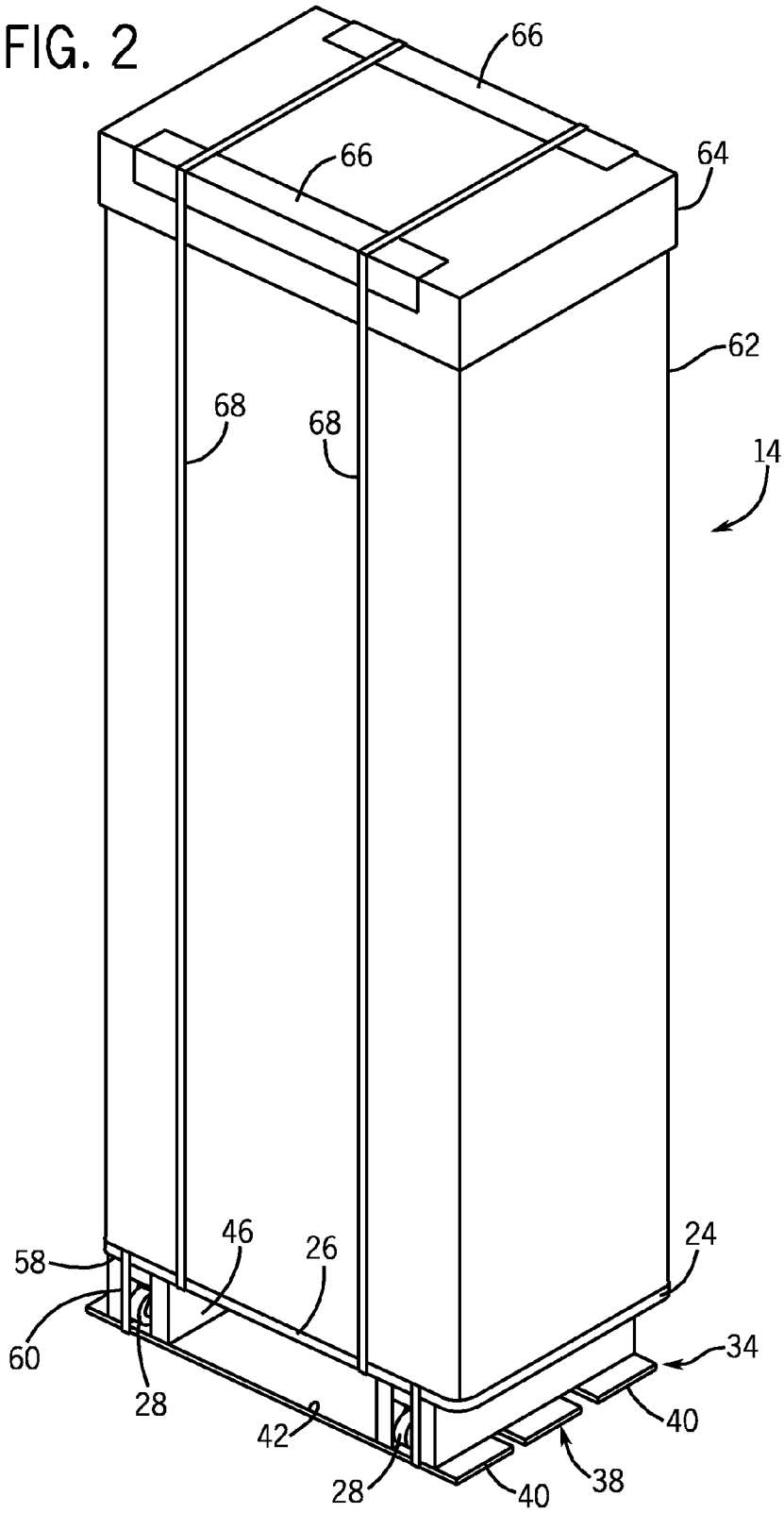
FIG. 2 is a perspective view of the combination mobile display and shipping device as shipped from the manufacturer to the retail outlet.

Referring now to FIG. 2, after the display rack 14 has been loaded with product and is ready to ship, the support platform 24 is mounted onto a shipping device 34. The combination of the mobile display 10 and shipping device 34 allows the entire unit to be shipped and moved using conventional equipment, such as the pallet jack 36 shown in FIG. 3. Referring back to FIG. 2, the shipping device 34 is designed to restrict the rolling movement of the individual wheels 28 mounted to the bottom surface 26 of the support platform 24.

Referring now to FIG. 6, the shipping device 34 is preferably a shipping pallet 38 having a plurality of individual slats 40. As illustrated in FIG. 6, the slats 40 are wood pieces spaced from each other in a conventional manner. The series of slats 40 define a generally planar base surface 42. The shipping pallet 38 includes a first pair 44 of upright supports 46 and a second pair 48 of upright supports 46. The first pair 44 of upright supports 46 are spaced from each other to define a first wheel channel 50 while the second pair 48 of upright supports 46 are spaced from each other to define a second wheel channel 52. Both the first and second wheel channels 50, 52 have a width large enough to receive the wheels 28 formed on the support platform 24, as best shown in FIG. 2.

Referring back to FIG. 6, the shipping pallet 38 further includes a pair of spacer blocks 54 each received within one of the first and second wheel channels 50, 52 to provide additional stability for the upright support 46. Both the spacer block 54 and each of the upright supports 46 extend perpendicular to the base surface 42 defined by the slats 40. Each of the upright supports 46 includes a generally planar top support surface 56 spaced from the base surface 42 by the height of each of the upright supports 46.

Referring back to FIG. 2, when the support platform 24 is positioned on the shipping pallet 38, the support surface 56 of each of the upright supports 46 contacts the bottom surface 26 of the generally planar support platform 24. In the embodiment shown in FIG. 2, the height of each of the upright supports 46 is greater than the distance from the bottom surface 26 of the support platform to the lowermost portion of each of the wheels 26. Thus, when the support platform 24 is mounted to the shipping pallet 38 as shown in FIG. 2, each of the wheels 28 is suspended slightly above the base surface 42 defined by the series of slats 40. Thus, when the support platform is mounted onto the shipping pallet 38, each of the wheels 28 is suspended above the base surface 42, and thus the ground surface, which prevents rolling movement of the mobile display.

Figure 3:
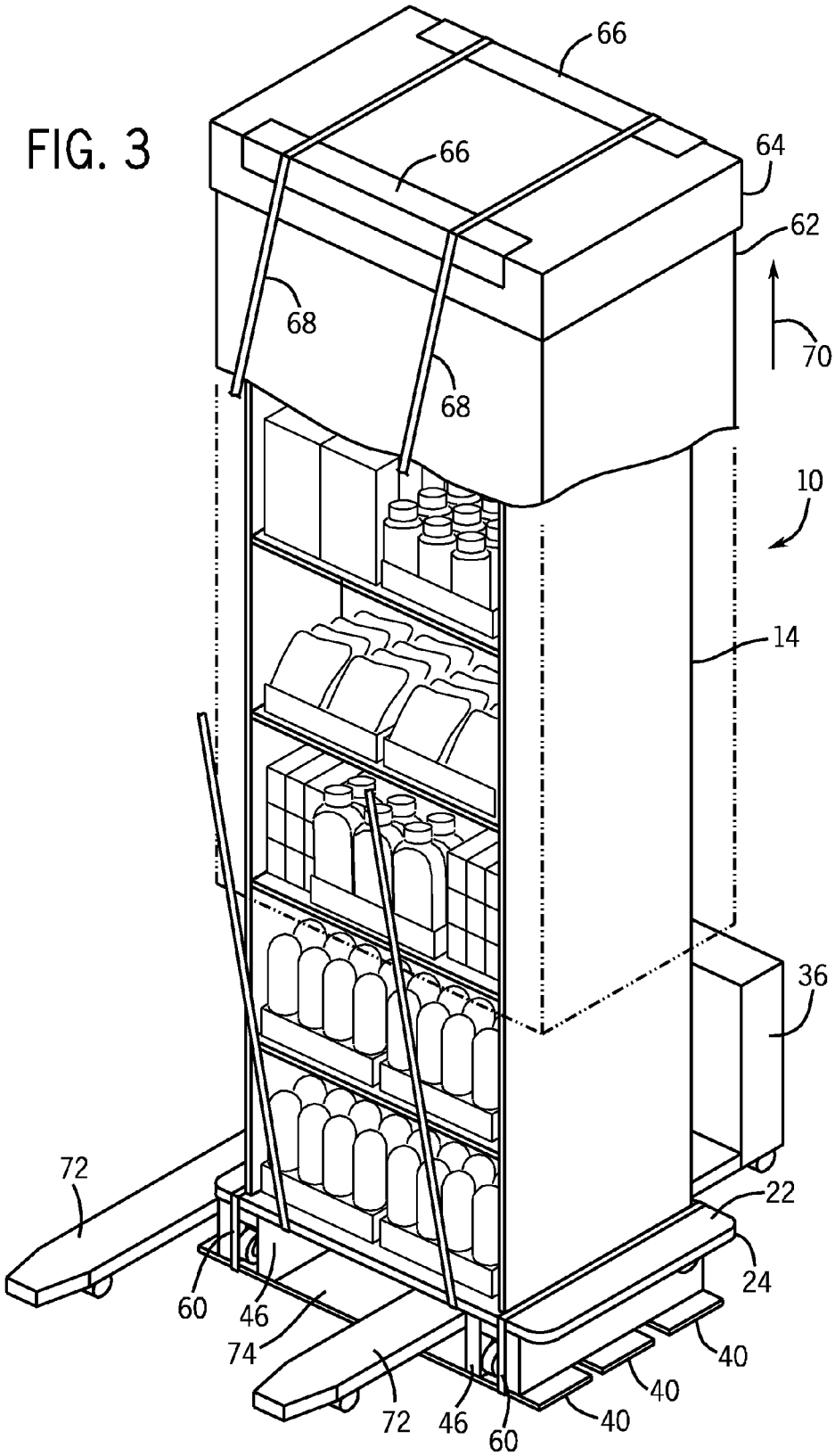
FIG. 3 is a perspective view illustrating the removal of the packaging material from the mobile display.
Figure 4:
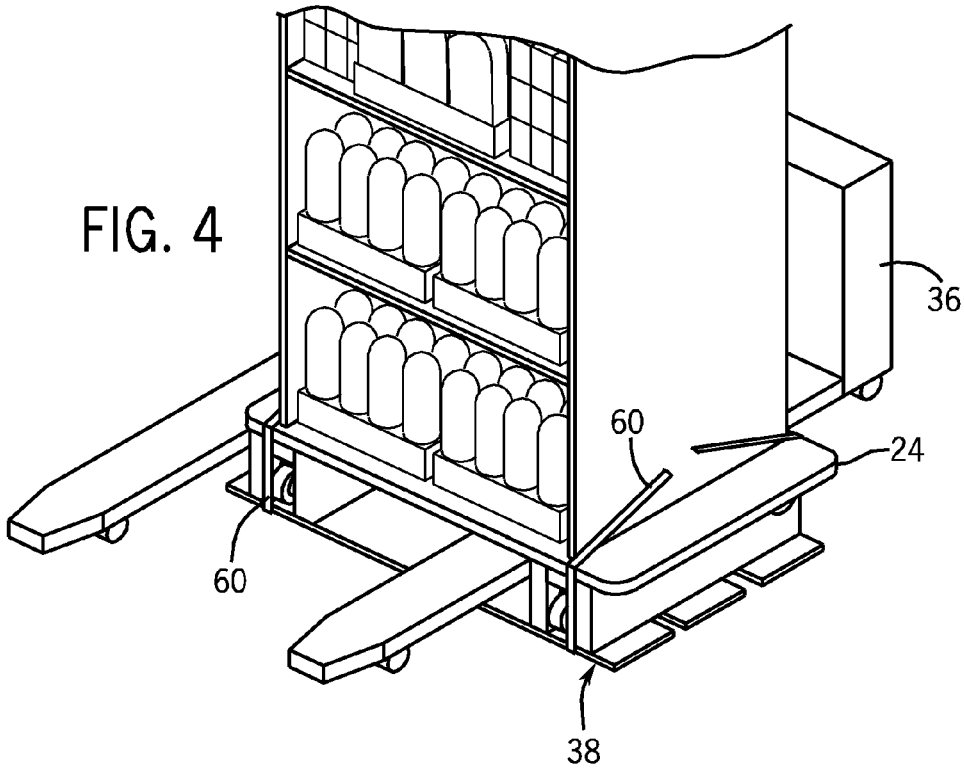
FIG. 4 is a partial perspective view showing the release of the shipping straps.

Referring to FIG. 3, the shipping pallet 38 is securely attached to the support platform 24 by a pair of shipping bands 60 that pass over the top surface 22 of the support platform 24 and under each of the slats 40 of the shipping pallet, as best shown in FIG. 3. In the embodiment shown in FIG. 3, each of the shipping bands 60 is formed from a plastic material, although other materials, such as nylon or metal, are contemplated as being within the scope of the present disclosure. As can be best be understood in FIGS. 2 and 3, the shipping bands 60 securely attach the support platform 24 to the shipping pallet 48 such that the two components do not separate during shipment.

Referring back to FIG. 3, the display rack 14 may be covered by a shipping container 62 having an upper lid 64. The shipping container 62 and upper lid 64 may be formed from paperboard or corrugated cardboard to provide additional protection for the product contained on the display rack 14. In the embodiment shown in FIG. 3, a pair of laminated paperboard edge protectors 66 are mounted on the upper lid 64 to provide additional protection from the shipping bands 68. The shipping bands 68 pass around and over the bottom surface of the support platform 24 to securely hold the shipping container 62 in place during shipment.

When the loaded mobile display 10 is received at the retail outlet or desired end location, the shipping straps 68 are cut and the shipping container 62 and upper lid 64 are lifted from the display rack 14, as shown by arrow 70. As illustrated in FIG. 3, either before or after the shipping container 62 has been removed, the combination of the mobile display and shipping device can be moved to a desired location within a facility by the pallet jack 36. Specifically, the pallet jack 36 is positioned such that one of the legs 72 extends through a center jack cavity 74 defined by a pair of the upright supports 46. Since the support platform 24 and the shipping pallet 38 are secured to each other by the pair of shipping bands 60, when the pallet jack 36 is raised, both the support platform 24 and the shipping pallet 38 travel as a single unit.

Figure 5:
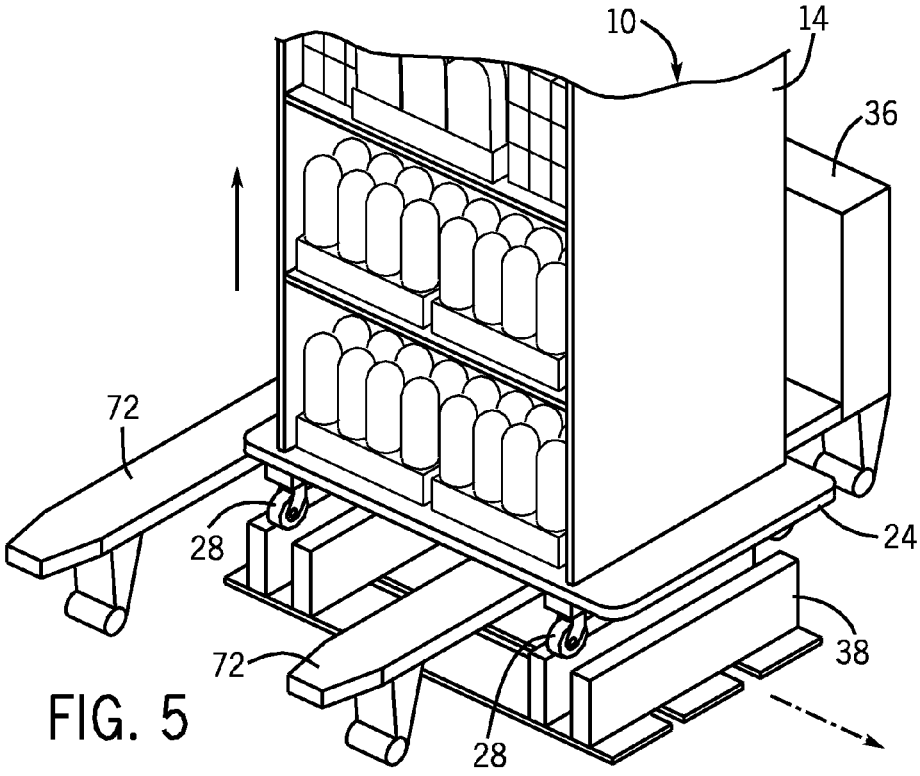
FIG. 5 is a partial perspective view illustrating the separation between the support platform and the shipping pallet.

Once the shipping container 62 has been removed, the pallet jack 36 lowers the shipping pallet 38 into contact with the ground surface, as shown in FIG. 6. Once the shipping pallet 38 is supported on the ground surface, the pair of shipping bands 60 are cut, which allows the support platform 24 to be separated from the shipping pallet 38 as the legs 72 of the pallet jack 36 are raised, as shown in FIG. 5. Once the support platform 24 has been sufficiently elevated, the shipping pallet 38 can be removed and the support platform 24 lowered until the wheels 28 contact the ground surface. Once the wheels 28 are in contact with the ground surface, the entire mobile display 10, including the display rack 14 and the support platform 24 can be rolled to the desired location within a retail outlet.

We claim:

1. A combination mobile display and shipping device, comprising:

a product display;

a support platform having a top surface and a bottom surface, the product display being supported on the top surface;

a plurality of wheels mounted to the bottom surface of the support platform to permit rolling movement of the support platform along a ground surface; and a shipping pallet including a base surface and a plurality of upright supports each extending perpendicular to the base surface, wherein the upright supports define at least a pair of wheel channels, wherein the upright supports contact the bottom surface of the support platform to suspend the plurality of wheels within one of the wheel channels and above the base surface of the shipping pallet when the support platform is supported by the shipping pallet to prevent rolling movement of the support platform during shipping.

2. The combination of claim 1 further comprising at least one shipping band positioned to securely attach the support platform to the shipping pallet.

3. The combination of claim 1 wherein the plurality of upright supports are spaced to define a center jack cavity.

4. The combination of claim 1 wherein the product display is a display rack including a pair of spaced sidewalls and at least one product display shelf mounted between the pair of spaced sidewalls.

5. A shipping and mobile support device for a product display, comprising:

a support platform having a top surface and a bottom surface, the product display being positionable on the top surface;

a plurality of wheels mounted to the bottom surface of the support platform to permit rolling movement of the support platform along a ground surface; and a shipping pallet including a base surface and a plurality of upright supports each extending perpendicular to the base surface, wherein the upright supports define at least a pair of wheel channels, wherein the upright supports contact the bottom surface of the support platform to suspend the plurality of wheels within one of the wheel channels and above the base surface of the shipping pallet when the support platform is supported by the shipping pallet to prevent rolling movement of the support platform during shipping.

6. The shipping and mobile support device of claim 5 further comprising at least one shipping band positioned to securely attach the support platform to the shipping pallet.

7. The shipping and mobile support device of claim 5 wherein the plurality of upright supports are spaced to define a center jack cavity.

* * * * *